United States Patent [19]

Lacey

[11] 4,199,272

[45] Apr. 22, 1980

[54] SYSTEM FOR RECHARGING AQUIFER AND APPARATUS THEREFOR

[76] Inventor: Edward H. Lacey, P.O. Box 796, Trent, S. Dak. 57065

[21] Appl. No.: 898,392

[22] Filed: Apr. 19, 1978

[51] Int. Cl.[2] ..... E02B 11/00

[52] U.S. Cl. ..... 405/36; 166/51; 405/50; 172/391; 210/271

[58] Field of Search ..... 166/51, 50, 278; 405/36, 40, 41, 50

[56] References Cited

U.S. PATENT DOCUMENTS

| | | | |
|---|---|---|---|
| 551,646 | 12/1895 | Newsom | 166/50 |
| 702,006 | 6/1902 | Huffman | 166/50 |
| 1,711,308 | 4/1929 | Enderson | 405/50 |
| 2,550,408 | 4/1951 | Fehlmann | 166/50 X |
| 3,837,168 | 9/1974 | Alsberg et al. | 405/50 |
| 3,898,940 | 8/1975 | Ede | 405/50 X |

*Primary Examiner*—Stephen J. Novosad

[57] ABSTRACT

A system for recharging an aquifer comprising an opening into the aquifer, means for packing the opening with sized, coarser, clean gravel, filter sand above the gravel and means for cleaning the filter sand.

6 Claims, 16 Drawing Figures

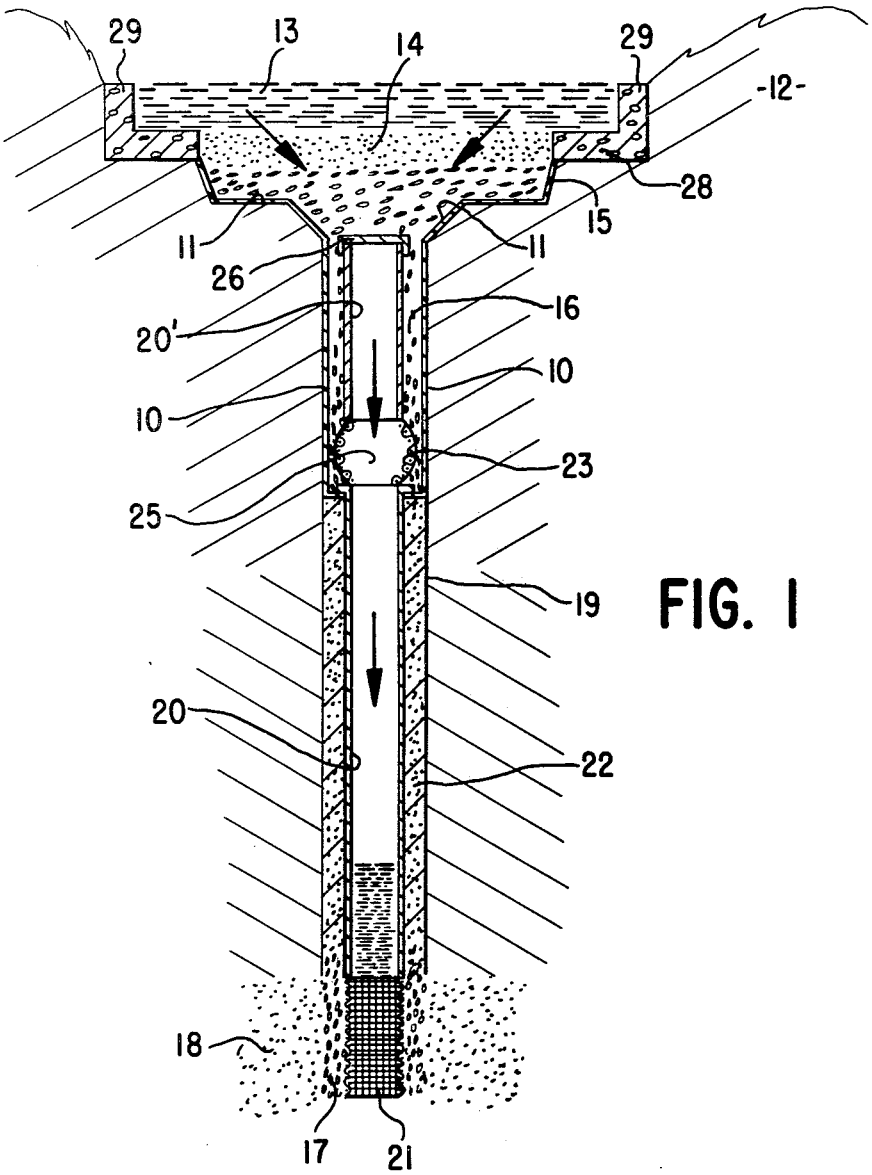
FIG. 1
FIG. 10
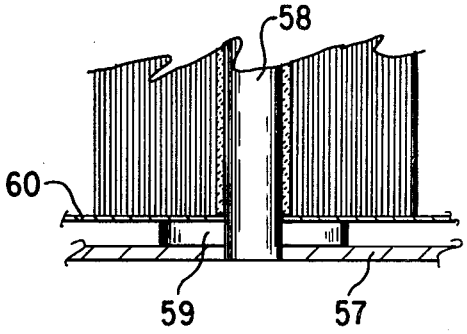

SYSTEM FOR RECHARGING AQUIFER AND APPARATUS THEREFOR

BACKGROUND AND SUMMARY OF THE INVENTION

This invention pertains to a system for recharging an aquifer for shallow wells and means for operating the system.

Aquifers of shallow or moderate depth are a common source of water used for irrigation and sometimes for municipal water systems. These aquifers are often found in broad flat flood plains of slow running rivers. It would be expected that the river would recharge the aquifer. However, the river beds of such rivers are frequently silted tightly so that the water does not seep into the aquifer. Then, the aquifer is recharged only when the river is at flood stage or by rain water or snow melt.

In order to provide for any other recharging of the aquifer it is necessary to remove or by-pass the siltation. The common means for recharging is to dig a large pit down to the level of the aquifer, then to fill the pit with gravel and filter sand and then to pump water from the river into the pit. However, the silt from the river water again soon fills the filter sand with silt which again blocks the water from flowing through the filter sand and the recharging pit is again ineffective. It is then necessary to dry the pit and replace the sand.

By my invention I provide a system of recharging the aquifer by use of wells or a trench dug into the aquifer. The opening is lined, preferably with a plastic membrane, and then filled with pea gravel and covered with filter sand.

I also provide novel means for lining the trench and cleaning the filter bed. By shaping the recharging area with a narrow trench into the aquifer and a broad filter bed it is possible to provide for lower siltation and easy cleaning of that bed by my novel means.

FIGURES

Figure 3:
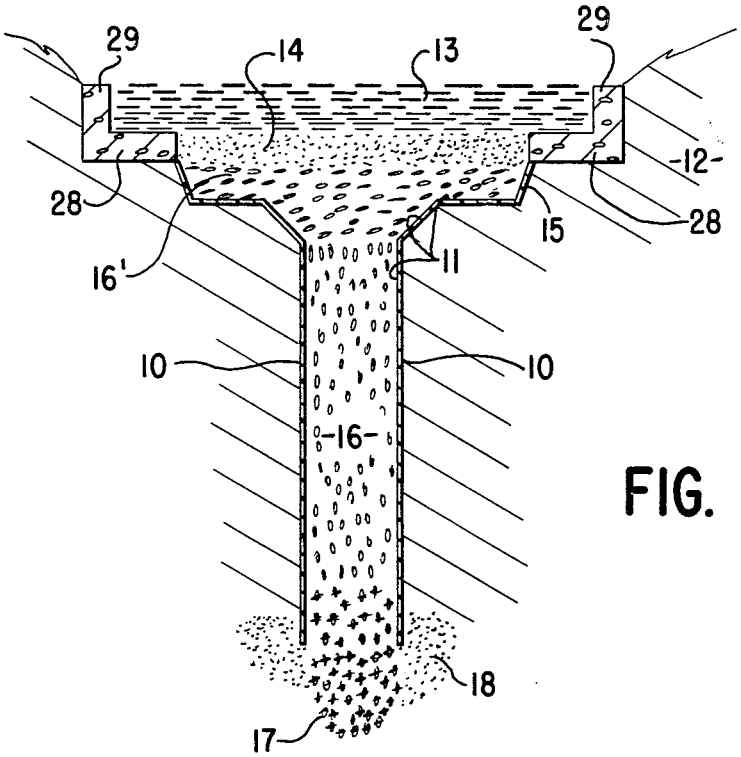
Figure 2:
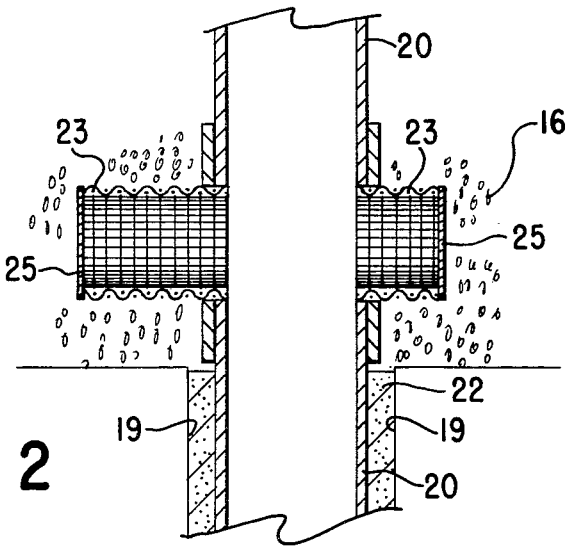
Figure 4:
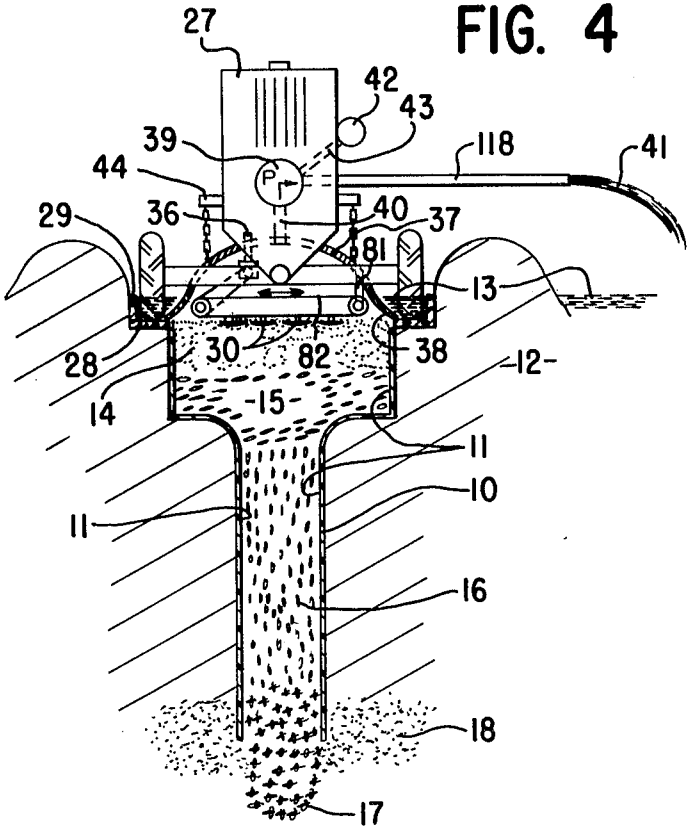
Figure 5:
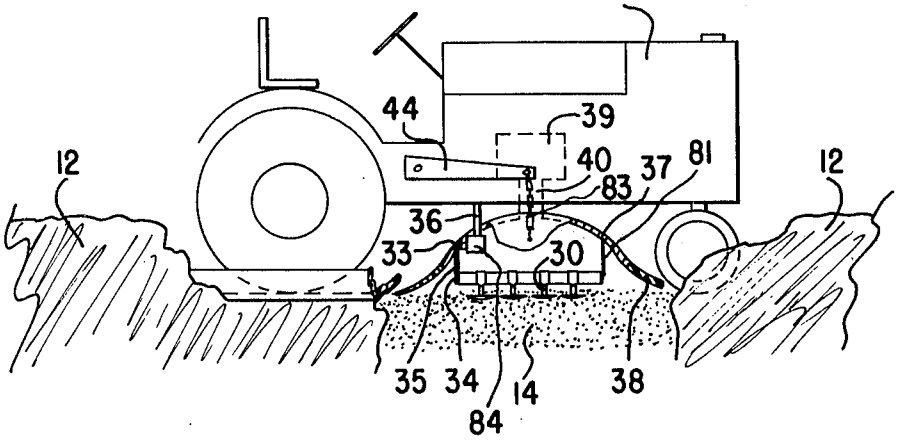
Figure 6:
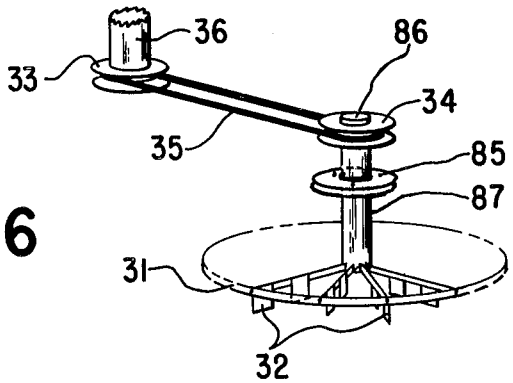
Figure 7:
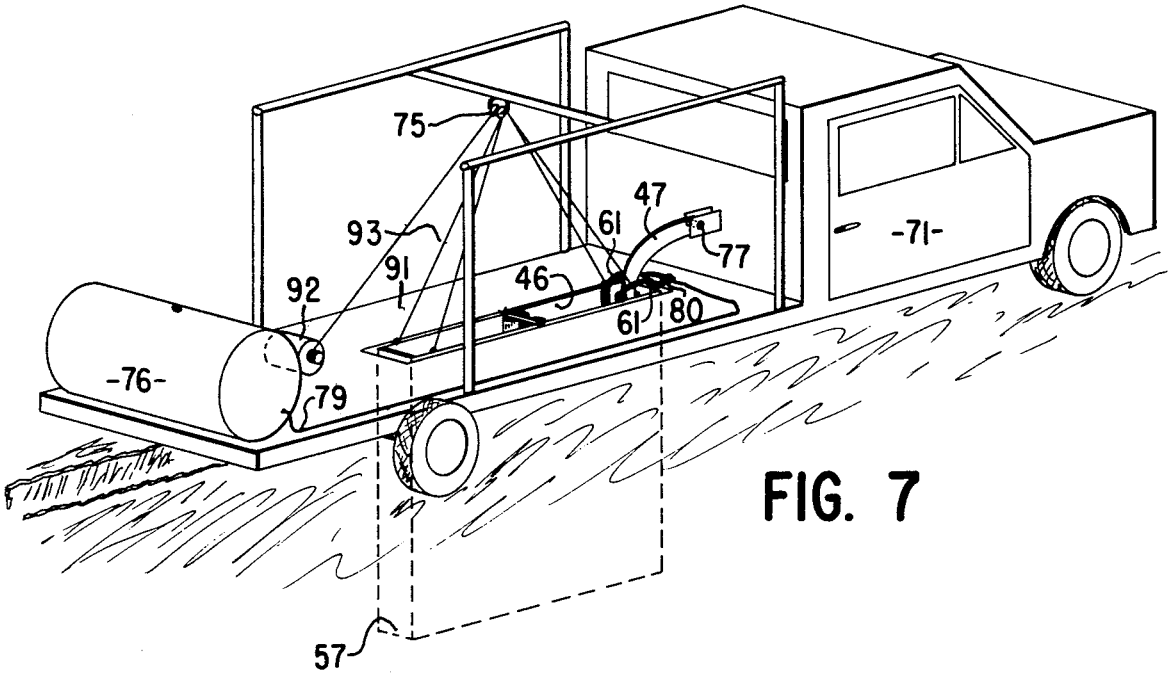
Figure 9:
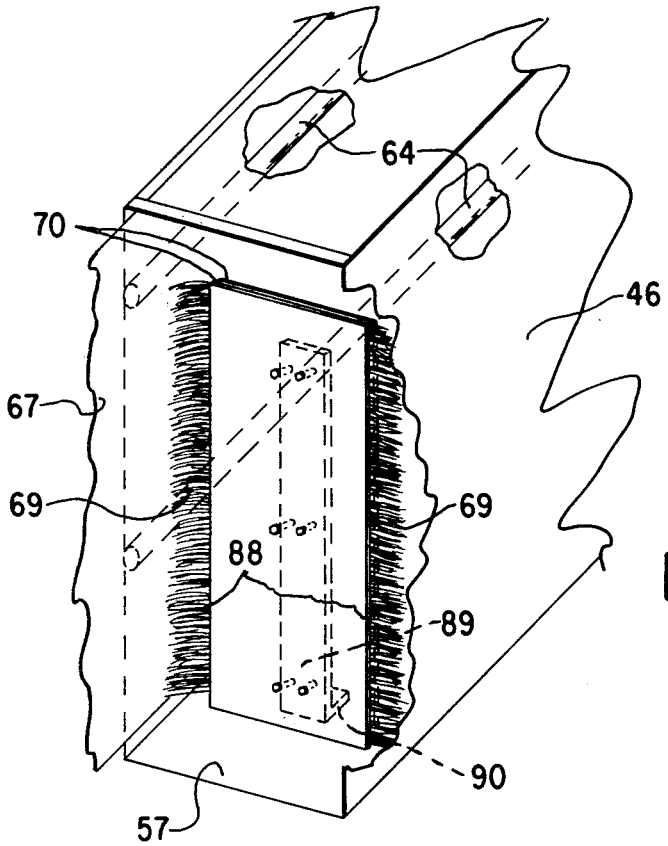
Figure 11:
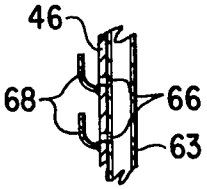
Figure 12:
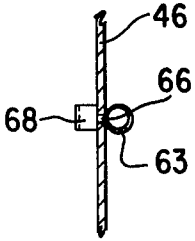
Figure 8:
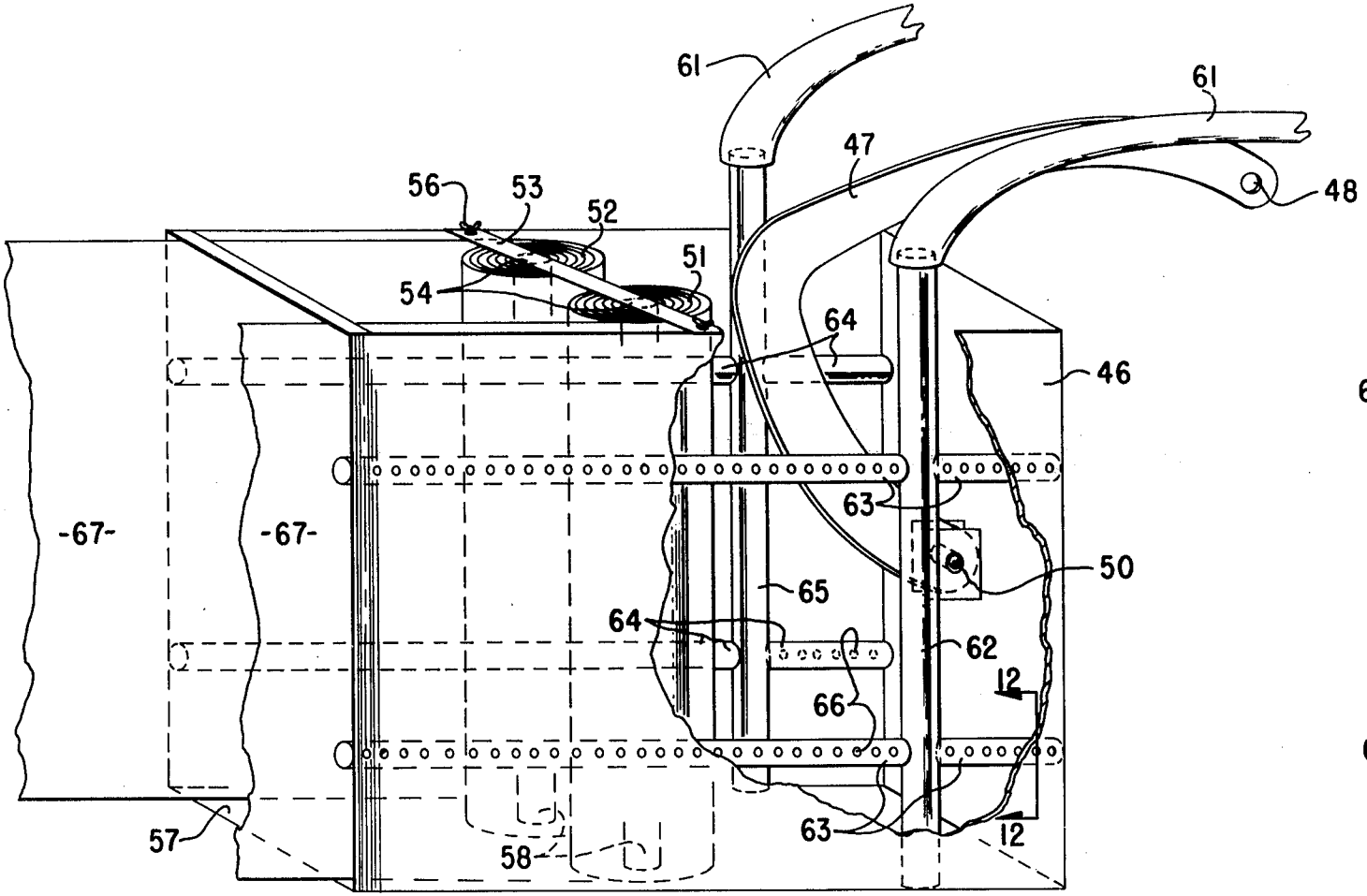
Figure 14:
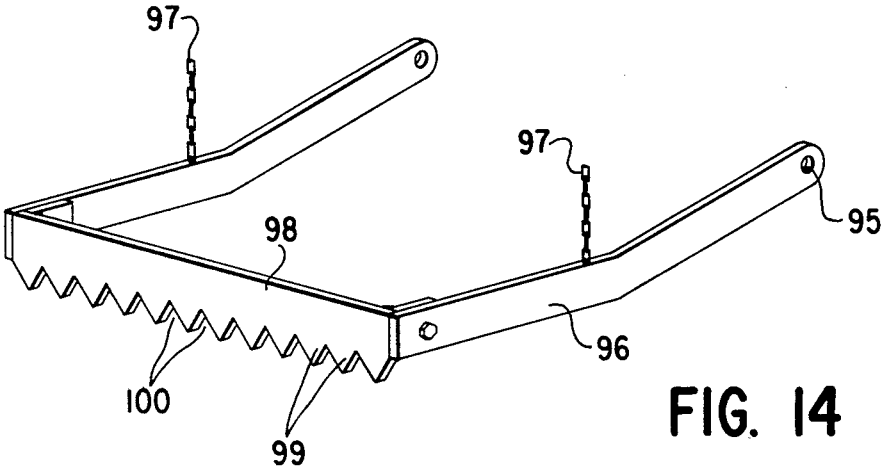
Figure 13:
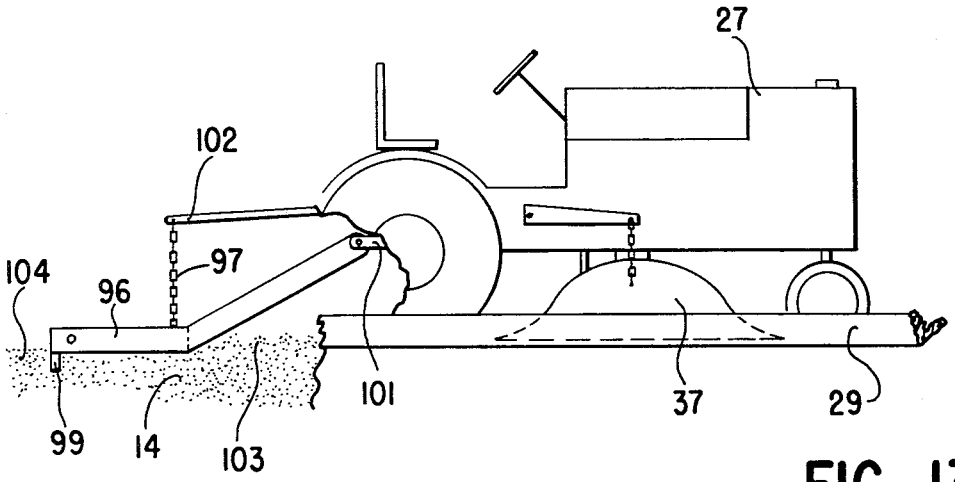
Figure 15:
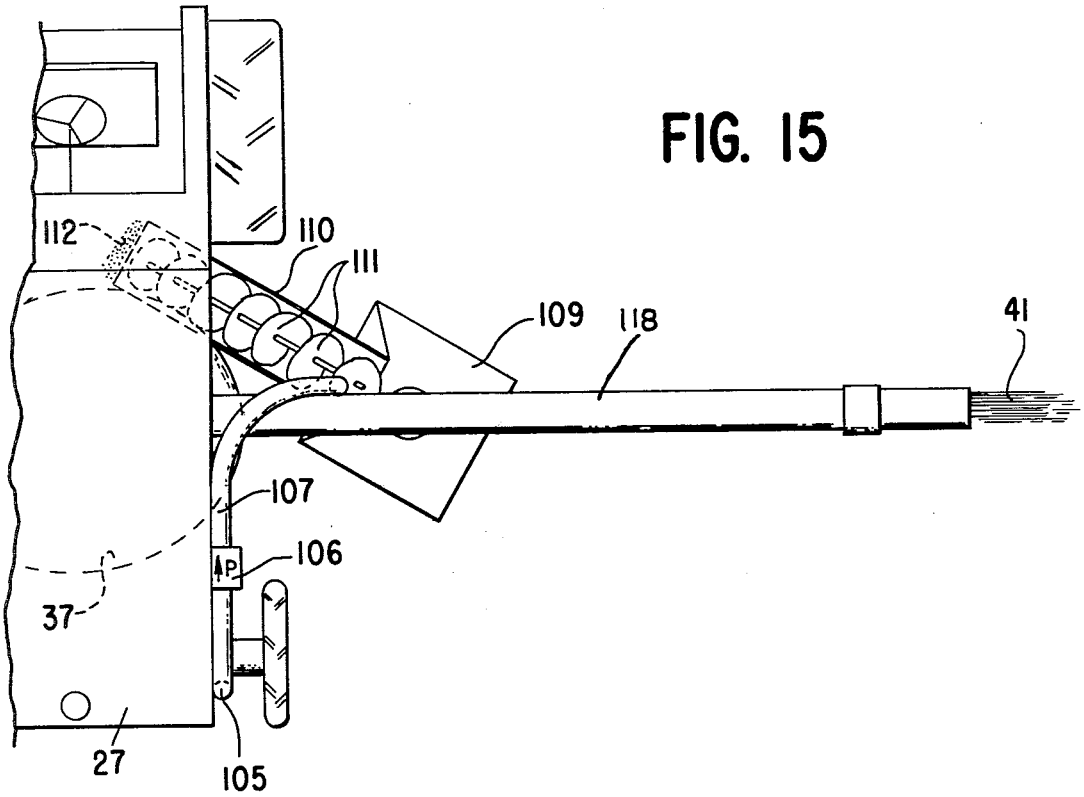
Figure 16:
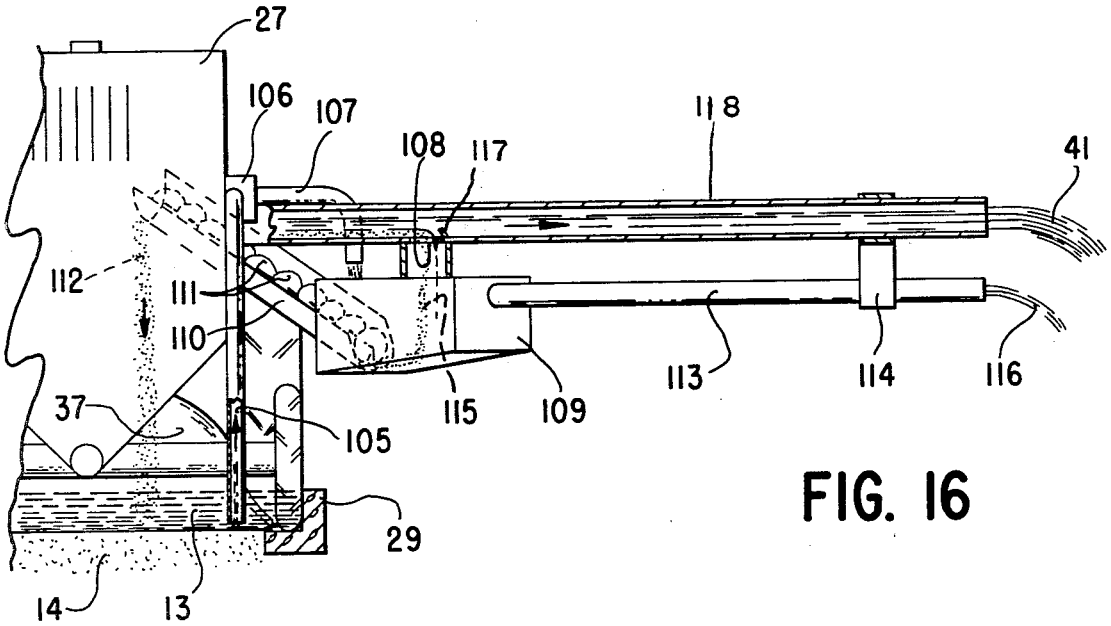

FIG. 1 is a sectional view of my recharging system as applied to a moderately deep aquifer, FIG. 2 is a detailed, enlarged sectional view of the system of FIG. 1 taken on a plane 90 degrees to the section of FIG. 1, FIG. 3 is a sectional view of the system as used in a shallow aquifer, FIG. 4 is a front elevational view of my filter bed cleaning machine in place over the system shown in FIG. 2, FIG. 5 is a side elevational view of the cleaning machine, FIG. 6 is a pictorial detailed view of one type of agitator that could be used on the cleaning machine, FIG. 7 is a pictorial view of the trench lining mechanism in place on a truck, FIG. 8 is an enlarged pictorial view of the trench liner placing mechanism, FIG. 9 is a rear pictorial view showing the discharge end of the liner placing mechanism, FIG. 10 is an enlarged detail view of the lower end of a liner roll in place, FIG. 11 is a detailed top sectional view of the wall lubricating means showing the lubricating parts and anti-plugging dirt covers, FIG. 12 is an end sectional view of the lubricating means shown in FIG. 11, FIG. 13 is a side elevational view of the tractor with a leveling rake attached, FIG. 14 is a detailed enlarged view of the rake, FIG. 15 is a detailed top view of the tractor showing a system for disposal of sand, water and silt pumped from the filter bed, and FIG. 16 is an elevational view of the system of FIG. 15 with parts broken away to show underlying parts.

DESCRIPTION

Briefly my invention comprises a system for recharging a relatively shallow aquifer and the mechanism which makes the system operate. The system includes the provision of a trench or series of trenches dug into the aquifer, lined preferably with flexible membrane-like material and filled with pea gravel. A filter bed of fine sand is provided above the gravel, and a novel means is provided to clean the filter bed of silt and return the sand to the bed. Also, means may be used to provide a corrugated surface on the filter bed to provide more surface through which water may filter and gulleys in which silt will rest leaving the peaks of the corrugations free to receive the recharging water.

More specifically, and referring to the drawings, I envision that my system can be used either with very shallow or moderately deep aquifers. Referring first to FIGS. 1 and 2, I illustrate the use of my system in the relatively deep aquifer. In this system, a series of wells 19 is illustrated as reaching into the aquifer sand 18. A casing 20 is provided for the well, and terminates at its lower end in a screen 21. Around the screen I provide a gravel pack 17 of gravel large enough to provide for easy seepage of water to the aquifer sand. A grouted casing 22 is provided surrounding the casing 20 of the well at its lower part to prevent erosion of the walls of the well. Such erosion might well plug the aquifer sand with silt causing the well to become inoperative.

Above the grouted casings of the wells, I dig a trench lined with a membrane or film liner 10 preferably of a plastic material placed therein by my novel trench lining machine described hereafter. Within this trench I provide an extension 20' of the casing 20 having a cap 26 covering the upper end. A screen 23 connects the casing 20 and its extension 20'. This screen as best shown in FIG. 2 is of tubular shape having an axis running longitudinally of the trench. Caps 25 are provided at the ends of the screen tubes so that gravel and other foreign material will not get into the well.

At its upper part, the trench broadens out and is also lined by the plastic film 11 which may be integral with the liner 10 of the trench. Gravel 16 of the approximate size of pea gravel fills both the trench and a part of the flared trench 15. The pea gravel surrounds the extension 20' and the screen 23 at the top of each well. A layer 16' of gravel somewhat finer than the pea gravel 16 may be used in the flared trench above the coarser gravel 16 to support the filter sand 14.

Above the flared part 15 of the trench, I provide curbings 29 having an ell-shape with the foot 28 of the ell running inward toward the trench. As will be explained later, these curbings thus form a pair of tracks on which my novel device for cleaning the filter bed may run. Between the curbings and above the gravel layer 16' I provide a filter bed 14 of relatively fine sand. Preferably, this sand is filled to the approximate level of the top of the feet 28 of the curbing.

In order to operate this type of recharging system, water 13 is introduced from an outside source such as an adjacent stream, river, pond or the like into the space between the curbings. This water filters through the filter bed 14 into the gravel 16 and 16'. It then can seep rapidly through that gravel and through the screen 23 into the casing 20. From there it runs out of the lower screen 21 through the gravel 17 into the aquifer sand 18, thus recharging the aquifer. The relative sizes of the gravels and sands are of considerable importance. The gravel 16 should not be greatly different from that in the aquifer. More important, however, is the gradation between the filter sand 14, the support bed 16' and the pea gravel 16. The support bed must be fine enough to block any tendency of the filter sand to move into the coarser gravel 16.

For use with very shallow aquifers the system may be modified as shown in FIG. 3. In this system, the trench extends directly into the aquifer sand 18 and therefore can conduct the water 13 directly to the aquifer. In other respects the construction of the trench and filter bed are similar to that of the trench and bed used between the wells as shown in FIG. 1.

Unique means for cleaning the filter bed of my system is illustrated in FIGS. 4, 5 and 6. The device is shown above the shallow aquifer system in which the curbing feet 28 firmly based on the surrounding ground 12 provide tracks on which a tractor 27 can run. A hool 37 is suspended from beneath the tractor by chains 83 from arms 44. The arms 44 are adapted to raise the hood or lower it as may be desired. A rubber rim or flap 38 surrounding the hood 37 provides a seal by which water from the system can be pulled out of the hood. A pump 39 is provided for the purpose of pumping water from the hood which is discharged through a pipe 118 as at 41. If necessary, a constant prime pump 42 may be used to keep the pump 39 primed through the connection 43 between the pump 42 and the pump 39.

In order to be effective, in cleaning the filter bed, the silt which often clogs the bed must be removed from the filter sand and mixed in with the charging water 13. The water carrying the silt can then be pumped out by the pump 39. The agitation is accomplished by an agitator. This agitator takes at least two forms. My preferred form is shown in FIGS. 4 and 5. The agitator consists of a series of disks 30 mounted on a belt 82. The belt is driven in an oscillating manner by a belt 35 operating through pulleys 33 and 34. Power to the pulleys may come through a shaft 36 from the tractor 27 although independent power could also be used. For example an electric or a hydraulic motor could be used for that purpose. A gear box 84 may be used to convert the rotary motion of the shaft 36 to the oscillating motion required by the belt. The agitator is supported from the hood 37 by supports 81.

The alternate agitator shown in FIG. 6 is also driven from the shaft 36. In this case a gear box for the conversion of motion is not needed so that the pulley and belt system can drive a shaft 86 more directly. The shaft 86 is journalled in a sleeve 87 which can be supported from the hood on a flange 85. A wheel 31 having open spokes supports flaps 32 extending downward from the spokes. Rotation of the wheel 31 causes the flaps to sweep the filter bed under water and therefore to stir the silt into the water. Then the pump 39 can suck out the waterborne silt and discharge it, leaving a clean sand filter bed.

Construction of the trench and lining can be easily accomplished by means of the mechanism shown in FIGS. 7, through 12. As shown in these figures, the lining mechanism may be mounted on a truck 71 and is enclosed in a container having sides 46 and a floor 57. This container is mounted so as to be vertically movable through the bed 91 of the truck. In order to avoid interference with the drive train of the truck, the device should be mounted to one side of the centerline of the truck, offset from the drive train. In some cases, it may be desirable to mount the container on a device pulled by the ditching machine. The time would thus be reduced during which the trench walls could collapse, and then placement of the gravel immediately behind the trailer carrying the container would almost certainly assure proper formation of the trench.

The lifting mechanism may be of many forms as will appear to those skilled in the art. I have illustrated a cable system including a winch 92 adapted to pull the cables 93 attached to the corners of the container 46 and running over a sheave 75. In order to prevent binding and unequal pulling, I provide a control arm 47 pivotally attached to the container at pivot 50 and to a bracket 77 mounted on the truck 71. It will be apparent that an hydraulic lifting mechanism could also be used.

The mechanism used to line the trench is best shown in FIGS. 8 and 9. A pair of rolls of plastic film or membrane 51 and 52 are each rotatably mounted on a vertical spindle 58. The spindle is journalled in a thrust bearing 59 (FIG. 10) mounted on the floor 57 of the container. The rolls of membrane 51 and 52 are supported vertically by a plate 60 fixed to the spindle 58. At the upper end of each spindle I provide a bearing 54 mounted on a cross bar or plate 53. This plate may be attached to the sides 46 of the container by wing bolts 56 or other easily detachable means so that the rolls can be replaced readily. From these rolls, the membrane sheets 67 are paid out to the rear of the unit.

As noted in the description of the system itself, the trench is filled with gravel. In order to prevent the gravel from entering the mechanism for laying the lining membranes, I provide a brush assembly 88 (FIG. 9) adapted to sweep the membrane as it runs out of the rear of the mechanism. This assembly is supported from the floor 57 of the container by a bracket 89 having a foot 90 fixed to the floor. The assembly includes a two-part wall 70 adapted to clamp brush members 69 between the two parts. The wall is adapted close the rear of the container except for the part occupied by the brushes. The brushes 69 are placed so as to press the membrane 67 against the walls 46 of the container, and thus to close completely the rear end of the mechanism making entry of gravel into the container impossible.

In order to provide for ease of pulling the device through the trench, I provide novel means for lubricating the sides 46 of the container. This means includes a series of perforated tubes 63 and 64 attached to the inner surface of both sides 46. The perforation 66 extend through the sides 46 so that liquid in the tubes can flow out and wet the sides.

Means for getting the liquid to the perforated tubes 63 and 64 includes a tank 76 mounted on the truck 71 (FIG. 7) connected by a tube or pipe 79 to a junction 80 with a pair of tubes 61. These tubes are flexible so that lifting the container does not interfere with the flow of liquid. The tubes 61 are attached to manifold tubes 62 and 65 which in turn carry the liquid to the perforated tubes 63 and 64.

I also provide means to protect the ports 66 from becoming clogged with soil from the sides of the trench. This means comprises merely small guards or covers 68' (FIGS. 11 and 12) fixed to the side 46 and having lips spaced from the side and overhanging the port. Thus, liquid can always flow from the port 66, down the side 46 and keep the side wet. Although other liquids may be used, I have found that water works well and is my preferred liquid.

In order to provide a somewhat more efficient filter bed, I propose to use a bed forming device as best shown in FIGS. 13 and 14. This device comprises a rake consisting of arms 96 pivoted at 95 to the lower members 101 of a three point hitch on the tractor 27. The upper member 102 of the hitch may be connected to the arms 96 by means of chains 97 thus providing for raising and lowering of the rake. A rake member 98 may be bolted cross ways between the arms 96. This member is formed with teeth 99 formed by notches 100 in the lower edge of the member 98. Although I have shown the rake member 98 as a solid bar, I envision that it might be desirable to perforate the bar or to fabricate it from narrow members forming an open rake so as to permit water on the filter bed freer passage through the rake.

In use, this rake is simply pulled behind the tractor 27 over the surface 103 of the sand bed 14. Ahead of the rake, that surface may be very rough and irregular because of dumping of cleaned sand as described hereafter, or may be very smooth because of the action of the water covering it. In either case, the teeth 99 as pulled over the bed will level out the discharged sand and other irregularities and form a longitudinally corrugated surface 104. This type of surface has a greater area of sand presented to the water for the water to filter through, and also provides a surface in which the silt and other clogging impurities can fall into the valleys of the corrugations while the water filters through the peaks which will remain unclogged. Thus, the filter bed becomes more efficient and will stay useful for longer periods of time.

A means for separating, cleaning and returning sand to the sand bed 14 is shown in FIGS. 15 and 16. This means is mounted on the tractor 27 and is used with the hood 37 and its associated pump and cleaning apparatus which discharges through the pipe 118. It will be evident from the foregoing description that the water being discharged from the pipe 118 will be carrying a certain amount of sand as well as silt and other clogging impurities. By the illustrated device, I propose to recover most of the sand and return it to the bed 14. In some instances it may be desirable to pick up the complete filter bed, wash the sand and return it. This is also possible with this device.

In order to accomplish my purpose, I cut a slot 108 in the bottom of the pipe 118 and provide a dam 117 at the edge of the slot toward the discharge end (at 41) of the pipe. The sand, being considerably heavier than the water will flow along the bottom of the pipe 118 and be blocked by the dam 117 and fall out through the slot 108. Some of the water may also discharge through the slot, but the amount will be relatively small and inconsequential.

The sand 115 falling from the slot is caught by a hopper 109 supported beneath the slot 108. From this hopper, it is removed by an auger 111 running in a trough 110. To prevent silt and the like from being returned to the bed with the sand in the trough 110, I provide for water to be pumped from the recharging water 13 through a pipe 105 mounted at the front of the tractor. The pump 106 then discharges the relatively clean water through a pipe 107 onto the sand in the trough 110 and washes the lighter silt back into the hopper 109. When the level of water reaches the upper part of the hopper, an overflow pipe 113 conducts the water to a discharge end at 116 at approximately the same place as the discharge 41. The pipe 113 may be carried by a support 114 attached to the pipe 118. The cleaned washed sand 112 is dropped from the trough 110 back into the bed 14 where the rake 98 will level it again to form the efficient filter which is the goal of my invention.

I claim:

1. For recharging an aquifer including water bearing sand, a system comprising means defining an entrance into said aquifer including a trench extending toward said aquifer, said trench being lined with a membrane composed of relatively water tight material, particulate means disposed within said trench and adapted to conduct water into said aquifer, said entrance being relatively confined at its lower end at the aquifer and having a broadened upper end upon which water can be placed, and curb means defining said broadened upper end and adapted to confine the water therebetween.

2. The device of claim 1 in which said means defining said entrance includes a series of wells extending between said trench and said aquifer, and well liners in said wells adapted to confine said water and direct it into said aquifer.

3. The system of claim 2 in which said well liner includes screen means located near the bottom of said trench through which the water may run into said wells and thence into the aquifer.

4. The system of claim 1 in which each said curb means includes a horizontal foot part extending inward toward said trench and upon which a tractor or the like may be supported.

5. The system of claim 4 in which a filter bed lies above said particulate means and between said curbing feet, said water being adapted to filter through said filter bed into said particulate means and thence into said aquifer.

6. The system of claim 5 in which said particulate means includes coarse gravel extending into said trench and finer gravel lying above said coarse gravel and within said broadened upper end and said filter bed lies on said finer gravel.

* * * * *